US006814343B2

(12) United States Patent
Gliniecki et al.

(10) Patent No.: US 6,814,343 B2
(45) Date of Patent: Nov. 9, 2004

(54) CARBURETOR WITH PLASTIC IDLE SPEED ADJUSTMENT SCREW

(75) Inventors: Gary U. Gliniecki, Ruth, MI (US); Jeffrey H. Krueger, Reese, MI (US); Paul S. Learman, Bad Axe, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 10/315,564

(22) Filed: Dec. 10, 2002

(65) Prior Publication Data

US 2004/0108605 A1 Jun. 10, 2004

(51) Int. Cl.[7] ..... F02M 3/08
(52) U.S. Cl. ..... 261/71; 261/38; 411/512
(58) Field of Search ..... 261/65, 71, DIG. 38, 261/DIG. 84; 411/512

(56) References Cited

U.S. PATENT DOCUMENTS 3,414,244 A * 12/1968 Patterson, Jr. ..... 261/41.5
3,484,084 A * 12/1969 Simpson et al. ..... 261/41.5
3,618,906 A * 11/1971 Charron ..... 261/41.5
3,719,322 A * 3/1973 Gifford ..... 236/102
4,120,918 A * 10/1978 Codling ..... 261/41.5
5,322,645 A * 6/1994 Hammett et al. ..... 261/71
5,635,113 A * 6/1997 Walsh et al. ..... 261/71
5,948,325 A * 9/1999 Yanaka ..... 261/71
5,984,281 A * 11/1999 Hacker et al. ..... 261/71
6,003,845 A * 12/1999 Kus ..... 261/39.4
6,123,322 A 9/2000 Sasaki ..... 261/64.1
6,189,506 B1 2/2001 Vanderveen ..... 123/337
6,349,925 B1 2/2002 Tobinai et al. ..... 261/23.3

* cited by examiner

*Primary Examiner*—Richard L. Chiesa
(74) *Attorney, Agent, or Firm*—Reising, Ethington, Barnes & Kisselle, P.C.

(57) ABSTRACT

A carburetor including a main body and a throttle valve received in a mixing passage through the main body. The throttle valve is movable to adjust the quantity of a fuel and air mixture supplied to an engine. A carrier member on the main body has a threaded bore in which a shank of an idle speed adjustment screw is received to adjust and control the idle position of the throttle valve. The idle speed adjustment screw is formed of a polymeric material such that the shank is deformed by engagement with the threaded bore to reliably retain the idle speed adjustment screw in its adjusted position in the threaded bore.

14 Claims, 1 Drawing Sheet

CARBURETOR WITH PLASTIC IDLE SPEED ADJUSTMENT SCREW

FIELD OF THE INVENTION

This invention relates generally to fuel systems for internal combustion engines and more particularly to carburetors having an idle speed adjustment screw.

BACKGROUND OF THE INVENTION

Carburetors are generally utilized to produce and control the mixture of fuel and air delivered to an internal combustion engine. A carburetor having a main body with a mixing passage generally includes a throttle valve that is mounted on a shaft rotatable by a lever. The throttle valve is adjustable to various positions including an engine idle speed position and a wide-open throttle position. A spring is usually utilized to yieldably bias the throttle lever and the throttle valve to its idle position. To permit adjustment of the idle position, an idle speed adjustment screw of steel is received in the carburetor body and has a conical tip on its free end. The tip generally provides an adjustable stop that is engaged by an arm on the throttle shaft when the throttle valve is in the idle position. Rotation of the idle speed adjustment screw changes the location of the tip relative to the arm thereby changing the position at which the arm bears on the tip and thus the rotary position of the arm and throttle valve. In this manner, the idle position of the throttle valve is adjusted thereby modifying the idle speed of the internal combustion engine.

Typical idle speed adjustment screws are metallic and include a compression spring associated therewith to provide a generally axial force on the idle speed adjustment screw such that it does not change position during the operation of an internal combustion engine.

Idle speed adjustment screws are commonly adjusted during manufacture for various engines and idle speed configurations. A problem associated with utilizing a metallic idle speed adjustment screw is that the spring can lose its ability to provide sufficient torsional resistance if overcompressed resulting in undesirable movement of an idle speed adjustment screw. Also, after repeated adjustments to the idle speed adjustment screw, a metallic compression spring may lose its ability to provide sufficient torsional resistance for the screw to eliminate undesirable movement.

SUMMARY OF THE INVENTION

A carburetor idle speed adjustment screw is formed of a polymeric material such that its shank is deformed by engagement in a threaded bore and retains the idle speed screw in its adjusted position within the threaded bore, even after repeated adjustments. The carburetor has a main body with a fuel and air mixing passage in which a throttle valve is rotatably received to adjust the quantity of a fuel and air mixture delivered to an engine. A support member is carried by the main body and includes a threaded bore in which the shank of the idle speed screw is threaded to adjust and control an idle position of the throttle valve.

A polymeric idle speed adjustment screw facilitates adjustment of the engine idle speed by a user by retaining its adjusted position even after multiple adjustments. Further, the polymeric idle speed adjustment screw eliminates the need for a compression spring, therefore reducing the number of parts associated with the carburetor and thereby reducing the cost to manufacture and assemble the carburetor.

Objects, features and advantages of this invention include providing a carburetor which facilitates adjustment of the idle speed by an end user or operator, eliminates the need for a compression spring associated with a metal idle speed adjustment screw, reduces the number of parts in the carburetor, provides an idle speed adjustment screw that is capable of multiple adjustments without a loss of retention in its adjusted position within a threaded bore, is of relatively simple design and economical manufacture and assembly, and in service has a long useful life.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
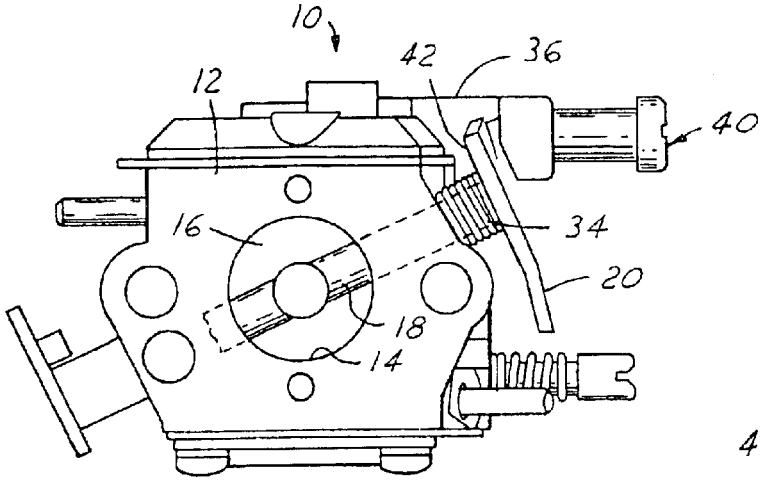
FIG. 1 is an end view at a carburetor embodying the invention.

FIG. 1 illustrates a carburetor 10 with a main body 12 that includes a mixing passage 14 in which a throttle valve 16 is mounted on a shaft 18 that is rotatable by a lever 20. The throttle valve 16 is movable between a first position that corresponds to an engine idle speed and a second position that corresponds to a wide-open throttle. A coil spring 34 yieldably biases the shaft 18 to maintain the throttle valve in its idle position when a force is not applied to the lever 20 to move the throttle valve to a more open position.

A carrier member 36 of the main body 12 has a threaded bore 38 formed therein in which an idle speed adjustment screw 40 is received to adjust and control an idle position of the throttle valve 16. The idle speed adjustment screw 40 provides an adjustable stop that is engaged by an arm 43 fixed to one end of the throttle valve shaft 18 when the throttle valve 16 is in its idle position. Rotation of the idle speed adjustment screw 40 changes the location of its tapered conical tip 42 relative to the arm 43 to change the position at which the arm bears on the tip 42 such that the rotary position of the throttle valve 16 is adjusted to change the idle speed of an internal combustion engine.

The idle speed adjustment screw 40 is formed of a polymeric material and configured so that a shank 60 of the idle speed adjustment screw 40 is deformed by engagement with the threaded bore 38 to retain the idle speed adjustment screw 40 in its adjusted position within the threaded bore 38.

Figure 3:
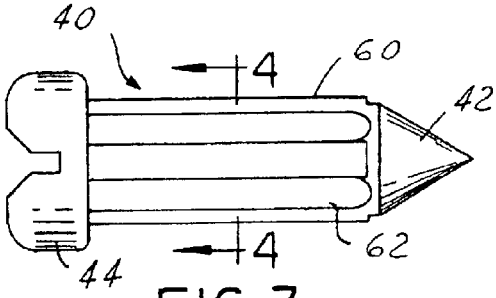
FIG. 3 is a side view of an idle speed adjustment screw of a first embodiment of the present invention.
Figure 4:
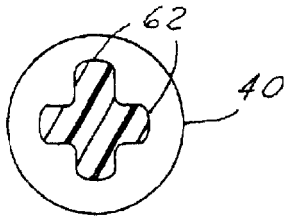
FIG. 4 is a sectional view of the screw of FIG. 3.

As shown in FIG. 3, the idle speed adjustment screw 40 has a shank 60 with a tapered end 42 spaced from a head portion 44. The idle speed adjustment screw 40 is preferably a self-threading screw which can conform to a wide range of thread patterns formed in the threaded bore 38. As can be seen in FIG. 3, the shank 60 includes longitudinally extending and radially projecting ribs or protrusions 62 circumferentially spaced apart on the shank 60. Preferably shank 60 has four protrusions 62 equally circumferentially spaced apart and axially coextensive with respect to each other. It is to be understood that other configurations including varying numbers of protrusions can be utilized by the present invention. For example, three or five protrusions may be positioned around the circumference of the shank 60 with equal circumferential spacing or with other spacings that may be desirable.

Figure 2:
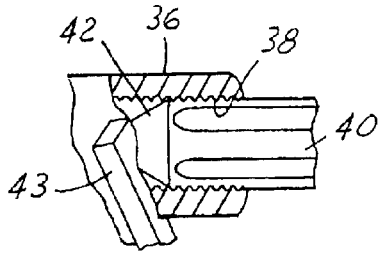
FIG. 2 is a fragmentary sectional view of the idle speed adjustment screw received within a threaded bore and bearing on a lever arm of a throttle valve.

The idle speed adjustment screw 40 of FIG. 3 in use is inserted into the metal carrier member 36 of the main body 12 and into the threaded bore 38 formed therein. Threads formed on the threaded bore 38 interact with the protrusions 62 formed on the shank 60 of the idle speed adjustment screw 40. The polymeric material of the shank 60 is deformed and conforms to the threads of the bore 38 to provide reliable retainment of the idle speed screw 40 in its adjusted position in the threaded bore 38 without any compression spring associated with carburetors known in the art. The tapered tip 42 as shown in FIG. 2, cooperates with the arm 43 attached to one end of the throttle valve shaft 18 such that the rotary position at which the arm bears on the tapered tip 42 adjusts the idle position of the throttle valve 16. The polymeric material of the idle speed adjustment screw includes material selected from the following group: acetal polymers including acetal copolymers such as polyoxymethylene, as well as nylon-based polymers and polyethylene. Particularly preferred polymeric materials include Celcon or Delrin 500 commercially available from Ticona and Dupont, respectively.

Figure 5:
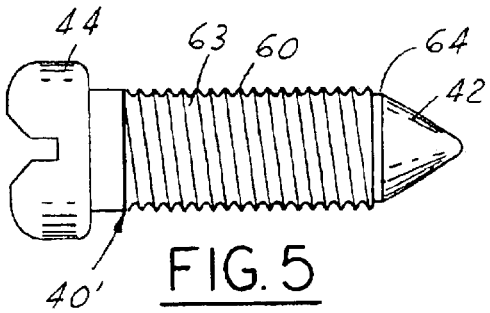
FIG. 5 is a side view of a second embodiment of the idle speed adjustment screw of the present invention.
Figure 6:
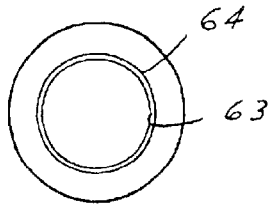
FIG. 6 is a cross-sectional view of the idle speed adjustment screw of FIG. 5.

As shown in FIG. 5, a second embodiment of the idle speed adjustment screw 40' has threads 63 formed on the shank 60. Initial threads 64 formed closest to the tapered tip 42 are sized for mating engagement with the threads of the threaded bore 38. The remaining threads 63 formed on the shank are sized such that they form an interference fit with the threaded bore 38. In this manner, the idle speed adjustment screw 40' is reliably retained in its adjusted position within the threaded bore 38. As with the first embodiment, the idle speed adjustment screw 40' is preferably formed of a polymeric material that allows for multiple adjustments of the idle speed adjustment screw 40' without losing retention with the threaded bore 38.

Figure 7:
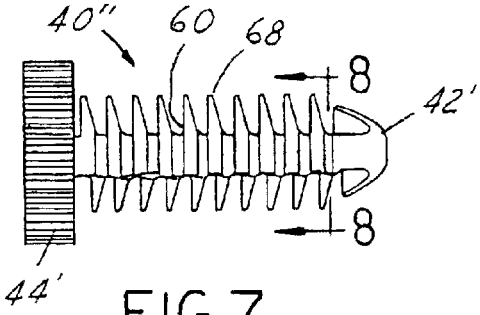
FIG. 7 is a side view of a third embodiment of the idle speed adjustment screw of the present invention.
Figure 8:
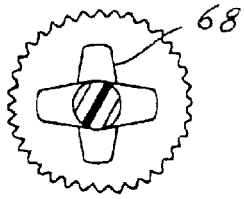
FIG. 8 is a cross-sectional view of the idle speed adjustment screw of FIG. 7.

As shown in FIG. 7, a third embodiment of the idle speed adjustment screw 40" has radially projecting fingers or fins 68 formed along the shank 60. Preferably, the fins are circumferentially and axially spaced apart in a generally spiral configuration about the shank. Preferably the tip 42' of the shank is dome-shaped and the head 44' is knurled or serrated and has a slot therein to receive a blade of a screwdriver. The fins 68 are sized such that engagement with the threads of the threaded bore 38 cause the fins 68 to deform and form an interference fit with the threaded bore 38. As with the first and second embodiments, the third embodiment is preferably formed of a polymeric material such that the fins 68 of the idle speed adjustment screw 40" can be repeatedly adjusted without loss of retention of its adjusted position in the threaded bore 38.

While preferred embodiments are disclosed, a skilled worker in this art would understand that various modifications can be made which come within the spirit and scope of the invention as defined by the following claims.

We claim:

1. A carburetor comprising:

a main body;

a throttle valve carried by the main body via a shaft having an end with an arm fixed thereto, the throttle valve being movable in response to movement of the arm to adjust the quantity of a fuel and air mixture supplied to an engine;

a carrier member carried by the main body and including a threaded bore formed therein;

an idle speed adjustment screw adjustable to change and control an idle position of the throttle valve, the idle speed adjustment screw including a solid shank for insertion into the threaded bore; and the idle speed adjustment screw formed of a polymeric material wherein the shank of the idle speed adjustment screw is deformed by engagement with the threaded bore for retaining the idle speed adjustment screw in its adjusted position in the threaded bore.

2. The carburetor of claim 1 wherein the shank further includes a tapered tip arranged for movement relative to the arm to change the position along the length of the tapered tip at which the arm engages the tapered tip.

3. The carburetor of claim 1 wherein the idle speed adjustment screw comprises a self-threading screw.

4. The carburetor of claim 3 wherein the screw includes a plurality of radially projecting ribs extending along and circumferentially spaced apart on the shank, the ribs being engaged with the threads in the threaded bore as the idle speed adjustment screw is inserted into the threaded bore.

5. The carburetor of claim 4 wherein the ribs are circumferentially equally spaced apart with respect to each other.

6. The carburetor of claim 1 wherein the polymeric material is selected from the group consisting of: acetal polymers, acetal copolymers, nylon polymers and polyethylene polymers.

7. The carburetor of claim 2 wherein the idle speed adjustment screw comprises threads formed on the shank, the initial threads relative to the tip are sized to allow mating engagement with the threads of the threaded bore and subsequent threads are sized to form an interference fit with the threaded bore.

8. The carburetor of claim 1 wherein the idle speed adjustment screw comprises a plurality of fins formed along a length of the shank.

9. The carburetor of claim 1 wherein the fins are sized such that engagement with the threads of the threaded bore causes the fins to deform and form an interference fit with the threaded bore.

10. The carburetor of claim 1 wherein the shank includes radially projecting protrusions positioned along a length of the shank, the protrusions being circumferentially spaced apart about the shank.

11. The carburetor of claim 10 wherein the protrusions are positioned circumferentially equally spaced apart with respect to each other.

12. The carburetor of claim 10 wherein the polymeric material is selected from the group consisting of: acetal polymers, acetal copolymers, nylon polymers and polyethylene polymers.

13. A carburetor comprising:

a main body;

a throttle valve carried by the main body via a shaft having an end with an arm fixed thereto, the throttle valve being movable in response to movement of the arm to adjust the quantity of a fuel and air mixture supplied to an engine;

a carrier member carried by the main body and including a threaded bore formed therein;

an idle speed adjustment screw adjustable to control an idle position of the throttle valve, the idle speed adjustment screw including a solid shank for insertion into the threaded bore; and the idle speed adjustment screw formed of a polymeric material wherein the shank of the idle speed adjustment screw is deformed by engagement with the threaded bore for repeatably adjusting a position of the idle speed adjustment screw without a loss of retention of the adjusted position in the threaded bore.

14. A carburetor comprising:

a main body;

a throttle valve carried by the main body via a shaft having an end with an arm fixed thereto, the throttle valve being movable in response to movement of the arm to adjust the quantity of a fuel and air mixture supplied to an engine;

a carrier member carried by the main body and including a threaded bore formed therein;

an idle speed adjustment screw adjustable to change and control an idle position of the throttle valve, the idle speed adjustment screw including a solid shank with a plurality of radially outwardly extending ribs disposed along and circumferentially spaced apart on the shank, the ribs being engaged with the threads in the threaded bore as the idle speed adjustment screw is rotatably inserted into the threaded bore, and the idle speed adjustment screw being formed of a polymeric material wherein the ribs of the idle speed adjustment screw are deformed by engagement with the threaded bore.

* * * * *